United States Patent [19]

Krob

[11] 4,214,777

[45] Jul. 29, 1980

[54] SKI BRAKE

[75] Inventor: Erwin Krob, Vienna, Austria

[73] Assignee: TMC Corporation, Baar, Switzerland

[21] Appl. No.: 905,023

[22] Filed: May 11, 1978

[30] Foreign Application Priority Data

May 18, 1977 [AT] Austria ..... 3559/77

[51] Int. Cl.[2] ..... A63C 7/10

[52] U.S. Cl. ..... 280/605

[58] Field of Search ..... 280/605, 604; 188/5

[56] References Cited

U.S. PATENT DOCUMENTS

| | | | |
|---|---|---|---|
| 3,964,760 | 6/1976 | Riedel | 280/605 |
| 3,989,271 | 11/1976 | Riedel | 280/605 |
| 4,033,602 | 7/1977 | Spieldiener et al. | 280/605 |
| 4,128,256 | 12/1978 | Weigl | 280/605 |

*Primary Examiner*—David M. Mitchell

*Attorney, Agent, or Firm*—Blanchard, Flynn, Thiel, Boutell & Tanis

[57] ABSTRACT

A ski brake construction utilizing a spring wire bent into a desired configuration so that the entirety thereof lies in a common plane. The spring has a portion which is bent generally into a U-shape with an intermediate bight portion interconnecting the legs of the U being received in an elongated and inclined slot in a holding plate device mounted on the upper surface of a ski. The intermediate bight portion has a general configuration to hold it in the aforementioned common plane even though the braking members are moved out of the common plane. As a result, a torsional force is developed in the spring, which torsional force effects an erecting of the brake after the ski boot is released from engagement with the ski bindings.

7 Claims, 9 Drawing Figures

IX - IX

SKI BRAKE

FIELD OF THE INVENTION

The invention relates to a ski brake with at least one braking member urged under the action of at least one spring into a braking position and can be swung into a downhill retracted position against a torsion force of the spring, the spring consisting of spring wire and has a leg which is connected to the braking member and a leg which is supported in a holding plate.

BACKGROUND OF THE INVENTION

Ski brakes are designed to prevent, in the case of a fall of the skier and a release of the safety binding, the ski from sliding away from the skier. Furthermore, ski brakes are to prevent a slipping of the ski during a stepping of the skier into the ski binding. To safely assure these functions, it is necessary that the ski brake is opened safely independent from a possible icing up or becoming dirty and safely transfers into the braking position. Furthermore, the force which presses the braking members into the braking position must be relatively large in order to lift, if possible, the ski and to also achieve good braking action even on hard packed slopes.

For this it has now become known to connect the braking member with torsion springs, which on the one hand permit a large erecting force and on the other hand can practically not be hindered by ice formation or dirt. Such torsion springs are now mostly realized with the aid of a U-shaped spring wire, the free legs of which are first bent outwardly and thereafter extend again approximately parallel to the edges of the ski. The bent section of the spring wire is thereby directed in an inclined manner to the longitudinal extent of the ski edge and is guided in a mounting arranged on the upper surface of the ski. By swivelling the free legs of the spring wire from their braking position into the retracted or downhill position, the spring wire is twisted in the area of its bent sections and applies a strong force urging the braking members into the braking position. A ski brake which is constructed in this manner is very safe in operation and also has a sufficiently large erecting force, however, it has the disadvantage that the spring wire has a three-dimensional configuration which extends into several planes, which in turn makes the manufacture of same more difficult. Moreover, the bearing portion which receives the spring is strongly stressed by the torsion force, in particular when the braking members are pulled in for the downhill position above the upper surface of the ski.

Also other ski brakes, which use torsion spring wires for producing the erecting force of the braking members, cannot be optimally manufactured in view of the manufacturing expenses.

Thus the basic purpose of the invention is to avoid the aforesaid disadvantage and inventively providing in a ski brake according to the above-mentioned type the legs of the spring wire to lie in the relaxed position substantially in one plane, and that the leg which is supported in the holding plate is curved or bent and is received in a bearing slot which lies approximately in the spring plane.

The spring wire which, because of the necessarily large erecting force, is very massive and must be bent only in one plane.

The leg which is supported in the holding plate preferably has an extension which is constructed as a second leg connected to a braking member. Furthermore it is preferred that one or several braking members are constructed in one piece as extensions of the spring wire.

The leg which is received in the bearing slot is bent substantially to a V-shape and the bent section of the V-shaped leg can be fixed in the bearing slot, for example can be clamped therein. In this construction, it can be achieved that the braking members move toward one another during an upward swinging from the braking position into the retracted downhill position.

BRIEF DESCRIPTION OF THE DRAWINGS

The invention will be discussed more in detail hereinafter with reference to the exemplary embodiments and with reference to the drawing figures, which exemplary embodiments are not to be limiting.

In the drawings

DETAILED DESCRIPTION

Figure 1:
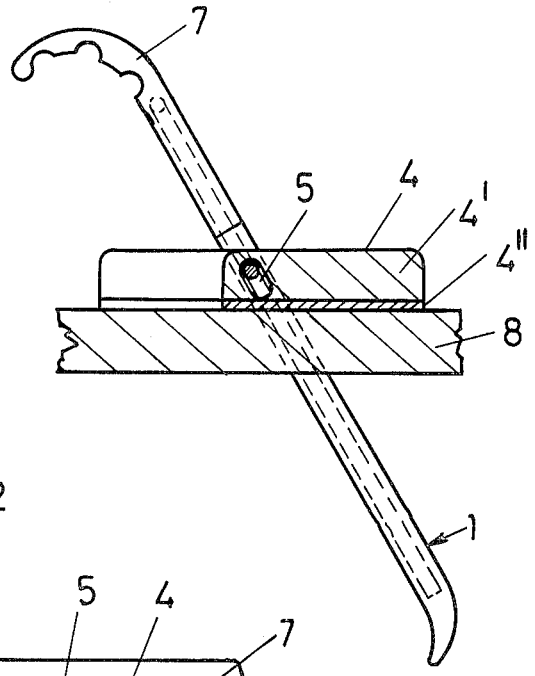
FIG. 1 is a partial cross-sectional side view of an inventive ski brake in the braking position.
Figure 2:
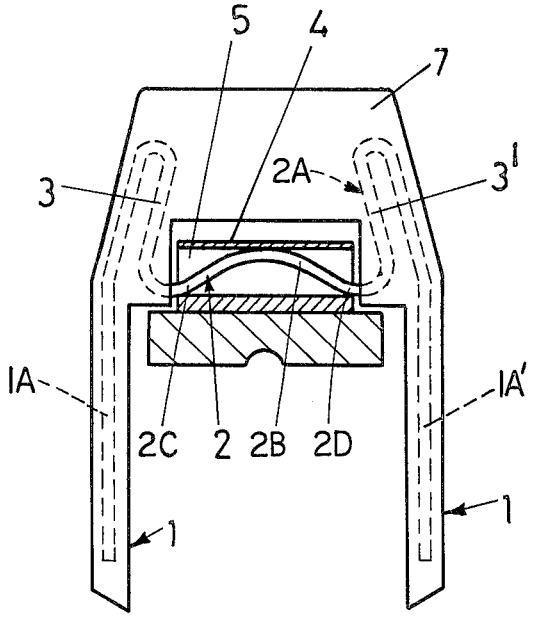
FIG. 2 is a cross-sectional view showing the front of the ski brake.

The exemplary embodiment which is illustrated in FIGS. 1 and 2 consists of a holding plate device 4, which is mounted on the upper surface of a ski 8. It is, however, also possible to integrate said holding plate device 4 into a sole plate or the like or to mount same onto such plate. The holding plate device 4 consists of two parts 4' and 4'' which are separated along a plane parallel to the plane of the ski and an elongated bearing slot 5 is provided in the upper part 4' which is inclined to the plane of the ski.

A torsion spring 2 is pivotally supported in the bearing slot 5. The torsion spring, in this embodiment, is bent into a general M-shape. The intermediate portion 2A of the M extending between the outer legs 1A, 1A' is generally U-shaped having upwardly and inwardly extending legs 3 and 3' integral with the upper ends of the legs 1A and 1A' and a bight portion 2B. The bight portion 2B is received in the bearing slot 5 and has a general arcuate shape so that the midportion thereof is spaced above the upper surface of the part 4''. The laterally outer segments of the bight portion 2B engage the upper surface of the part 4''. The intermediate portion 2A of the torsion spring produces the erecting force when the ski brake is pivoted from the braking position illustrated in FIG. 1 to the not illustrated retracted position. The braking legs 1A, 1A', just like the leg sections 3 and 3', are covered all around with a plastic layer so that at the same time a stepping plate 7 is formed. As can particularly be seen from FIG. 1, the braking members 1 are normally arranged in a common plane in this exemplary embodiment with the stepping plate 7 and the leg sections 3 and 3' when in the braking position. If now the stepping plate 7 is moved downwardly due to insertion of the ski boot into the ski binding, then the braking members 1 swing upwardly into their downhill position above the upper surface of the ski. As a result, the torsion spring becomes tensioned particularly in the areas between the leg section 3 and bight section 2C as well as the leg section 3' and bight section 2D. The bight portion 2B will then be inclined relative to the plane of the legs 1A, 1A' and leg sections 3, 3'. When the ski boot is removed from the ski binding, for example due to a fall and release of the safety binding, the spring wire is relaxed again and the braking members 1 will swing into their braking position. It can easily be seen, that such a ski brake can be manufactured with a minimum of expense and detail and, in addition, the especially simple form of the spring wire in only one plane is preferable.

Figure 3:
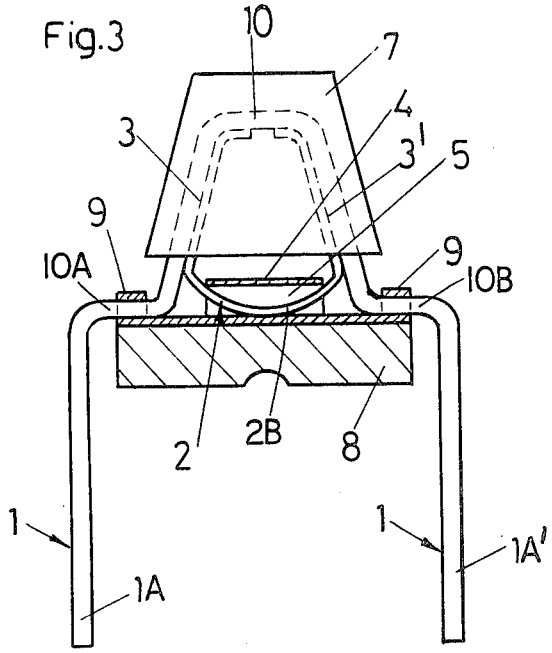
FIGS. 3 to 7 are cross-sectional front views similar to FIG. 2 but illustrating further modifications of the inventive ski bindings.

FIG. 3 illustrates a further exemplary embodiment wherein a wire bar 10 having the braking members thereon is separate from the torsion spring. The wire bar 10 is essentially rigid and has a pair of axially aligned and horizontally extending sections 10A and 10B intermediate the upper inverted U-shaped section and the braking legs 1A, 1A'. This wire bar 10 is rotatably supported in two bearing supports 9 on the holding plate 4. The wire bar 10 is covered in its area which is between the braking members 1 along with the torsion spring 2 with a plastic layer to form a stepping plate 7. A U-shaped torsion spring 2 has two leg sections 3 and 3' which are connected to a bight portion 2B received in the bearing slot 5 of the holding plate device 4. The operation is substantially the same as in the aforementioned exemplary embodiment.

Figure 4:
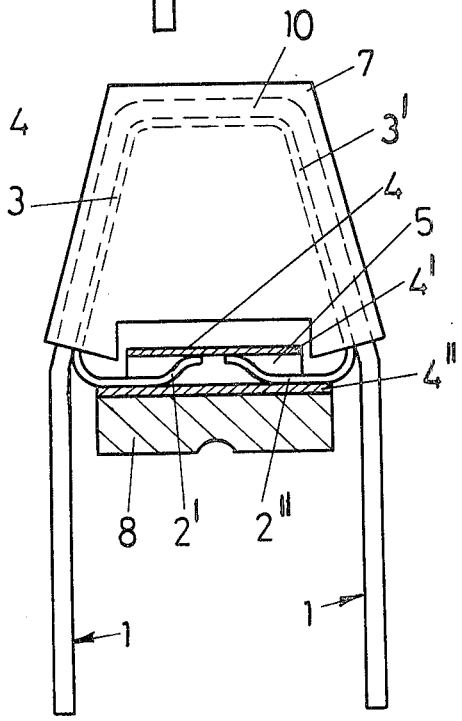

FIG. 4 illustrates an exemplary embodiment of the invention similar to FIG. 3, however, the wire bar 10 which forms the two braking members 1 has no separate axle segment supported on the holding plate device 4. The holding plate device 4 is here too like in FIG. 1 constructed in two parts 4', 4'', which are divided in a plane parallel to the ski plane. The torsion spring 2 is generally of an inverted U-shape with the bight portion of the U being coextensive with the bight portion of the wire bar 10. The lower ends of the leg sections 3, 3' are bent inwardly as at 2A and 2B. The mutually adjacent ends of inwardly bent sections are bent upwardly as at 2', 2'' so as to be spaced from the upper surface of the part 4''. The leg sections 2', 2'' extend into the bearing slot 5.

Figure 5:
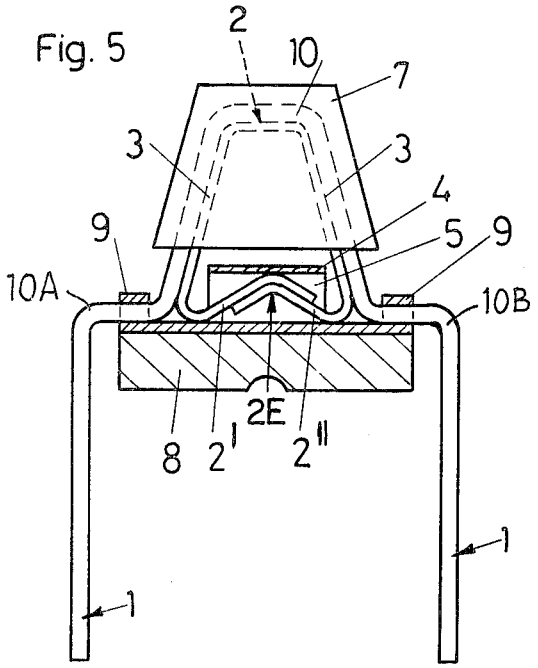

The modification illustrated in FIG. 5 uses axially aligned segments 10A and 10B on the wire bar 10 received in bearing portions 9. As in FIG. 4, the torsion spring 2 is U-shaped having inwardly extending sections 2' and 2'' projecting in the bearing slot 5, however, the two sections 2', 2'' are bent and partially overlap one another as at 2E. This will bring about advantages during the manufacture or during introduction of these leg sections into the bearing slot 5. A further advantage lies in the bearing portions 9 being subjected to less stress.

Figure 6:
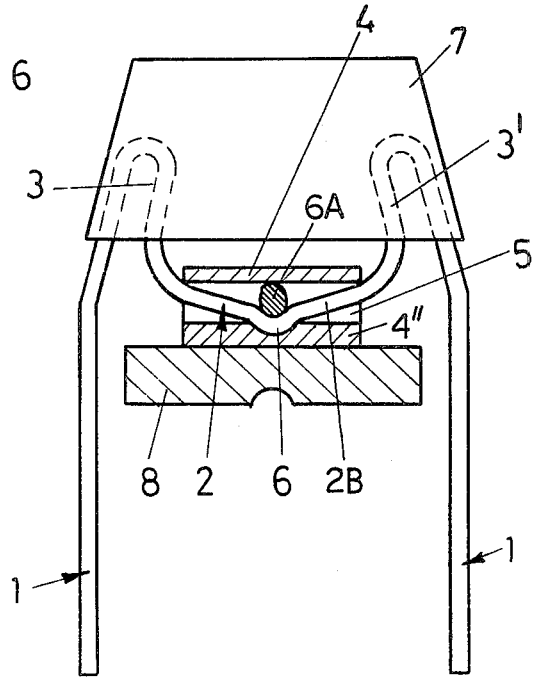

The modification illustrated in FIG. 6 utilizes a torsion spring 2 which is integral with the braking members 1. The shape of this spring is similar to the spring shown in FIG. 2. The bight portion 2B which is received in the bearing slot 5 is substantially V-shaped and has a bent section 6 at its midsection. The part 4'' of the holding plate device 4 has a pocket formed therein for receiving the bent section 6 therein. A block member 6A is pressed into the bearing slot 5 and is adapted to be received in the bent section in the wire on one side thereof and engage the upper surface of the bearing slot 5 on the other side thereof. As a result, the torsion spring 2 is maintained in a centered position in the bearing slot 5. It is possible to support the legs 3 and 3' and also the braking members 1 laterally movably in the stepping plate 7, so that during a stepping down on the stepping plate and during a swinging up of the braking members these are moved toward one another. To achieve this function, the upper ends of the leg sections 3 and 3' must be arranged pivotally in a bearing slot in the stepping plate 7 so that during a stepping down on the stepping plate 7 and through the guideway formed by the bearing slot, the bight portion 2B becomes aligned approximately rectilinearly and the braking members 1 are moved laterally inwardly.

Figure 7:
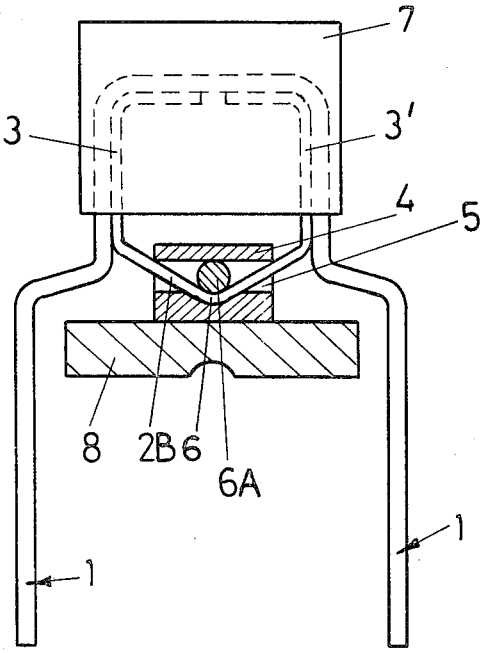
Figure 8:
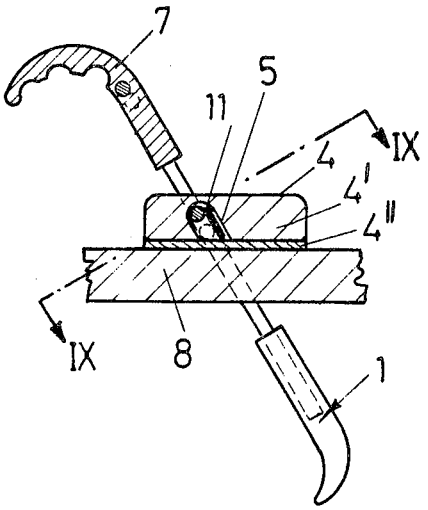
FIG. 8 is a cross-sectional side view of a modification of the ski brake.
Figure 9:
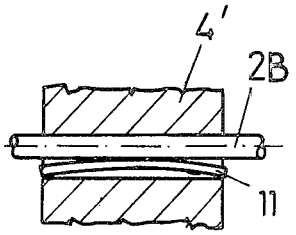
FIG. 9 is a cross-sectional view taken along the line IX—IX of FIG. 8.

FIG. 7 illustrates an exemplary embodiment in which the torsion spring and the braking members are constructed as separate structural elements. The exemplary embodiment which is illustrated in FIGS. 8 and 9 has additionally yet a spring 11 in its bearing slot 5, which spring prevents possible friction wear and urges the bight portion 2B against a surface of the slot 5. With a suitable dimensioning, during a swivelling of the braking bar from the braking position into the retracted position, first a relatively small counter force of the spring 11 is applied, and only in the second phase is the torsion spring tensioned. Stepping into the binding is thus made easier.

It can easily be seen that within the scope of the invention a plurality of possible exemplary embodiments are still conceivable.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski brake comprising a holding plate, at least one braking member and resilient means operatively connected to said braking member for urging said braking member into a braking position and resisting movement of said braking member into a downhill retracted position, the improvement comprising wherein said resilient means comprises a spring wire having plural segments which in a relaxed position of the spring wire lie substantially in one plane, wherein said braking member has a planar construction coplanar with said spring wire of said resilient means, and wherein said holding plate has a radially elongated bearing slot therein, the elongated axis of said bearing slot being upwardly inclined relative to an upper surface of said ski and lying in said plane of said spring wire, one segment of said spring wire having coplanar bent portions being received in said bearing slot, said coplanar relationship of said bent portions and said elongated axis of said bearing slot preventing rotary movement of said spring wire in said bearing slot to thereby effect a torsioning of said wire in response to a movement of said braking member to said retracted position.

2. The ski brake according to claim 1, wherein said bent portions of said resilient means which are received in said bearing slot in said holding plate have a pair of legs which are connected to said braking member.

3. The ski brake according to claim 1, wherein said braking member is constructed in one piece with said spring wire of said resilient means.

4. The ski brake according to claim 1, wherein said bent portions which are received in said bearing slot have a substantially V-shape.

5. The ski brake according to claim 4, wherein said bearing slot has a pocket therein, and including means for fixedly holding said V-shaped portion in said pocket.

6. The ski brake according to claim 2, wherein said legs which are connected to said braking member are constructed in one piece of spring wire and the terminal ends of said legs are received in said bearing slot.

7. The ski brake according to claim 1, wherein said holding plate is divided in a plane parallel to the ski plane, and wherein said elongated axis of said bearing slot which extends inclined to said ski plane is constructed in the upper part of said holding plate.

* * * * *